United States Patent [19]

Rider, Jr. et al.

[11] Patent Number: 4,482,176

[45] Date of Patent: Nov. 13, 1984

[54] MANUALLY OPERABLE LATCH FOR HINGED PULL-DOWN MEMBER

[75] Inventors: Frederick H. Rider, Jr., Youngstown; Joseph O. List, Cortland, both of Ohio

[73] Assignee: General Motors Corporation, Detroit, Mich.

[21] Appl. No.: 404,563

[22] Filed: Aug. 2, 1982

[51] Int. Cl.[3] ..... E05C 19/06

[52] U.S. Cl. ..... 292/87; 174/52 R

[58] Field of Search ..... 292/80, 81, 87, 88, 292/89, 91; 174/52 R, 48; 337/194, 195, 196, 208, 214, 212, 207; 339/10, 34; 248/324, 293; 312/242, 248, 322, 326, 274; 296/70; 180/90; 361/430

[56] References Cited

U.S. PATENT DOCUMENTS 4,371,743 2/1983 Decker ..... 174/52 R

*Primary Examiner*—Richard E. Moore

*Attorney, Agent, or Firm*—F. J. Fodale

[57] ABSTRACT

A three-piece fuse block assembly for an automotive vehicle comprises a bracket attached behind the front wall of the vehicle instrument panel, a fuse block hinged to the bracket for movement between a horizontally stored position and a vertically access position, and a manually operable latch attached to the fuse block for releasing the fuse block from the stored position and pulling it down to the access position.

2 Claims, 7 Drawing Figures

MANUALLY OPERABLE LATCH FOR HINGED PULL-DOWN MEMBER

This invention relates generally to a hinged pull-down member and, more particularly, to a manually operable latch for such a member.

Pending U.S. patent application Ser. No. 248,578, filed Mar. 27, 1981 discloses a hinged pull-down fuse block assembly for mounting in an automotive passenger vehicle and the like, so that the fuse block is normally stored in an out-of-the-way location for driver comfort and moveable to a very accessible position for installing or replacing fuses or other plug-in components.

The fuse block assembly comprises a hinged fuse block which is normally latched in a stored out-of-the-way position when the assembly is mounted behind the instrument panel, and a manually operable latch attached to the fuse block which is used to unlatch the fuse block and pull it down to a very accessible position for changing fuses and the like.

The object of this invention is to provide an improved manually operable latch for a hinged pull-down member such as the fuse block assembly disclosed in the aforesaid patent application.

More specifically, the object of this invention is to provide a manually operable latch having an arrangement for attaching the manually operable latch to the hinged pulled member in a more secure fashion.

Other objects and features of the invention will become apparent to those skilled in the art as the disclosure is made in the following detailed description of a preferred embodiment of the invention as illustrated in the accompanying sheets of drawing in which.

Figure 1:
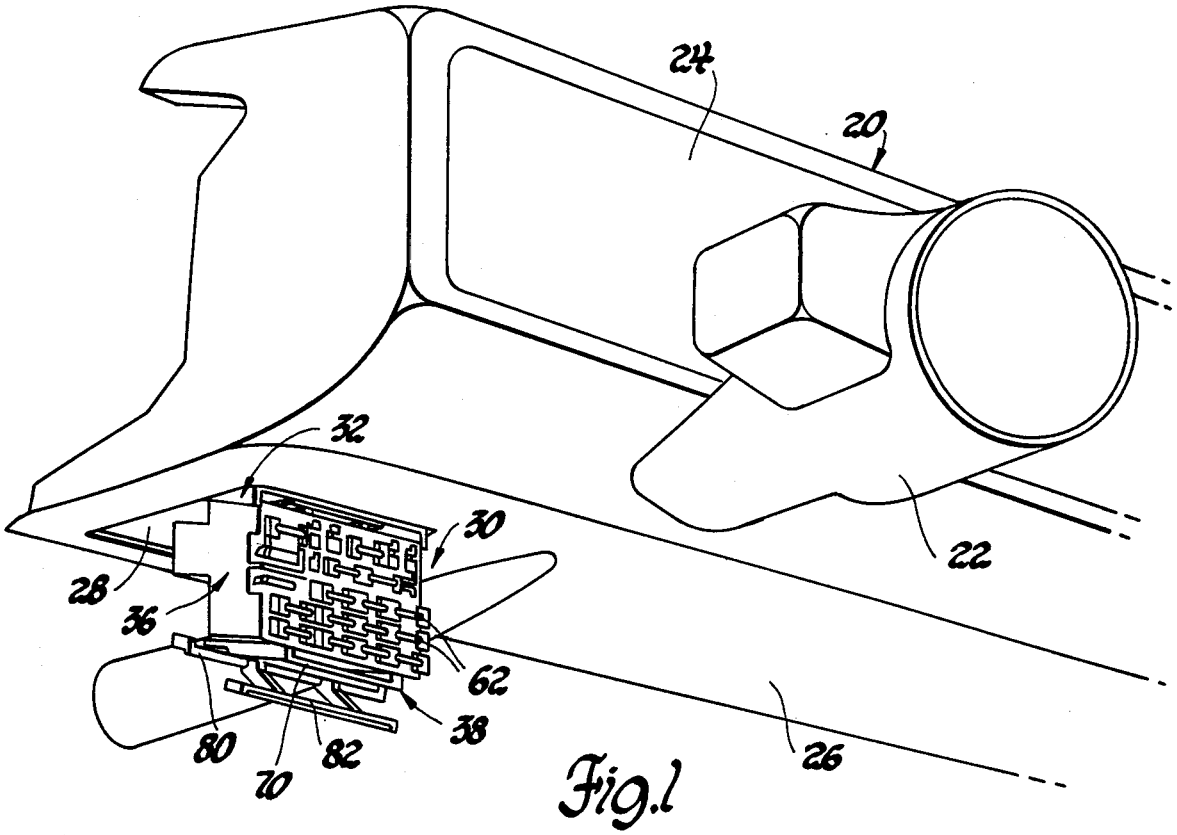
FIG. 1 is a perspective view of an automotive instrument panel equipped with a hinged pull-down fuse block assembly in accordance with this invention.
Figure 2:
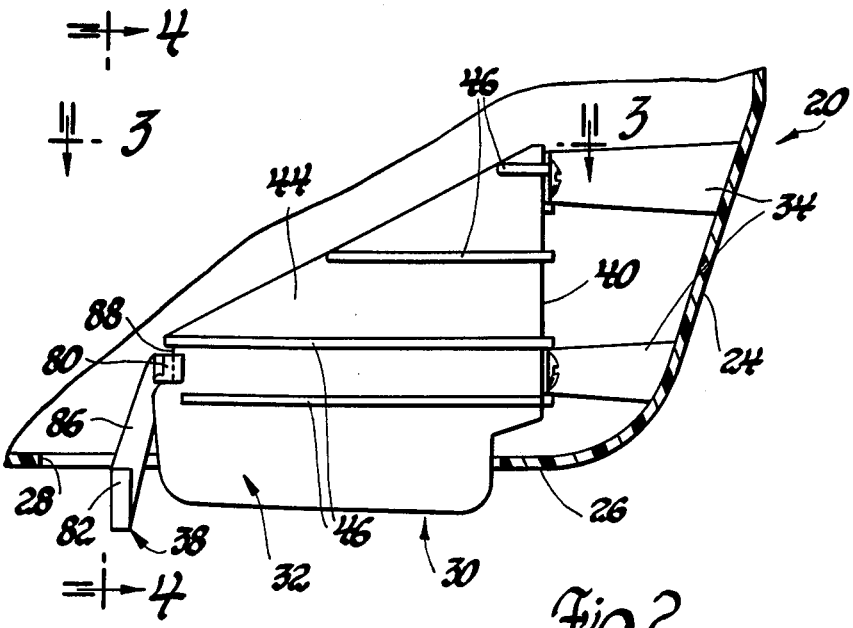
FIG. 2 is a vertical section through the instrument panel of FIG. 1 illustrating the fuse block assembly in another operative position.

Referring now to the drawing, FIGS. 1 and 2 illustrate an automotive instrument panel 20, particularly the portion which faces the driver as indicated by the steering column 22.

The instrument panel 20 generally projects toward the upper body of the seated driver. It has a generally vertical front wall 24 and a generally horizontal bottom wall 26 which is spaced from the vehicle floor to allow leg room for the driver.

The instrument panel 20 has a rectangular hole 28 in the bottom wall 26 which is just to the left of the steering column 22. A fuse block assembly 30 is mounted behind the front wall 24 of the instrument panel 20 over the rectangular hole 28.

The fuse block assembly 30 includes a bracket or frame 32 which is secured to mounting pedestals 34 integral with the front wall 24. The fuse block assembly 30 also includes a fuse block 36 which is hinged to the bracket 32 so that the fuse block 36 is moveable between a generally horizontal stored position shown in FIG. 2 and a generally vertical access position shown in FIG. 1.

The fuse block assembly 30 is shown in detail in FIGS. 3 through 8.

The fuse block assembly 30 comprises three components, the bracket or frame 32; the fuse block 36; and a manually operable latch 38 which engages the bracket 32 to hold the fuse block 36 in the stored position.

The bracket 32 is U-shaped in plan form having a front wall 40, and two side walls 42 and 44. The bracket 32 is strengthened and stiffened by a number of generally horizontal internal and external ribs 46 on the walls 40, 42 and 44.

Figure 5:
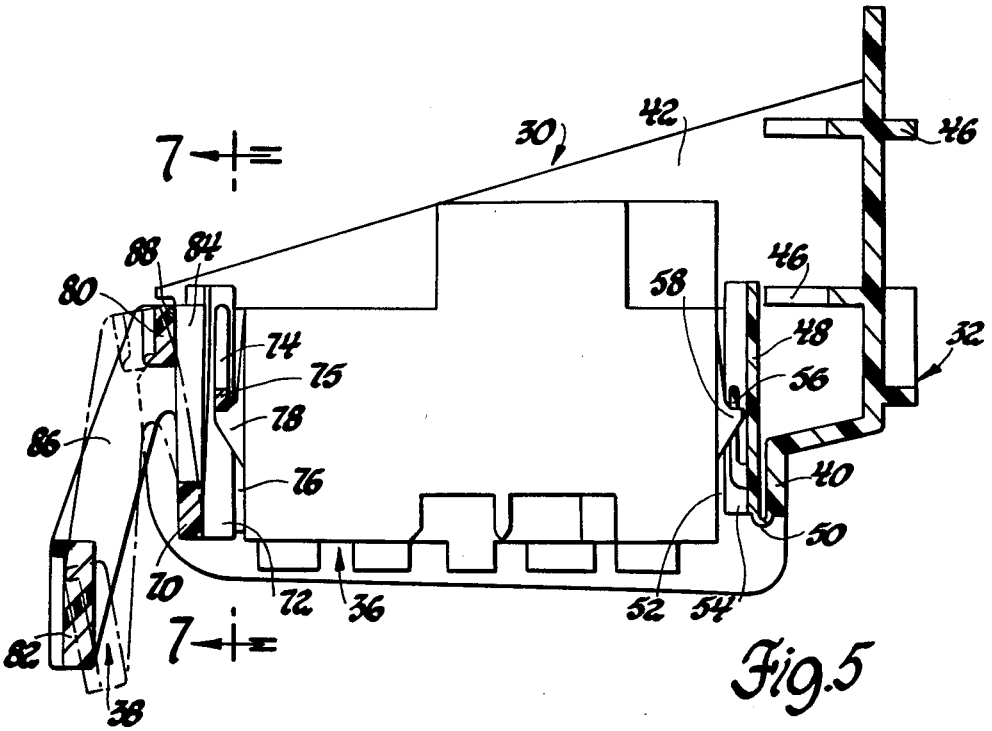
FIG. 5 is a section taken substantially along the line 5—5 of FIG. 3 and showing the fuse block in the stored position.
Figure 6:
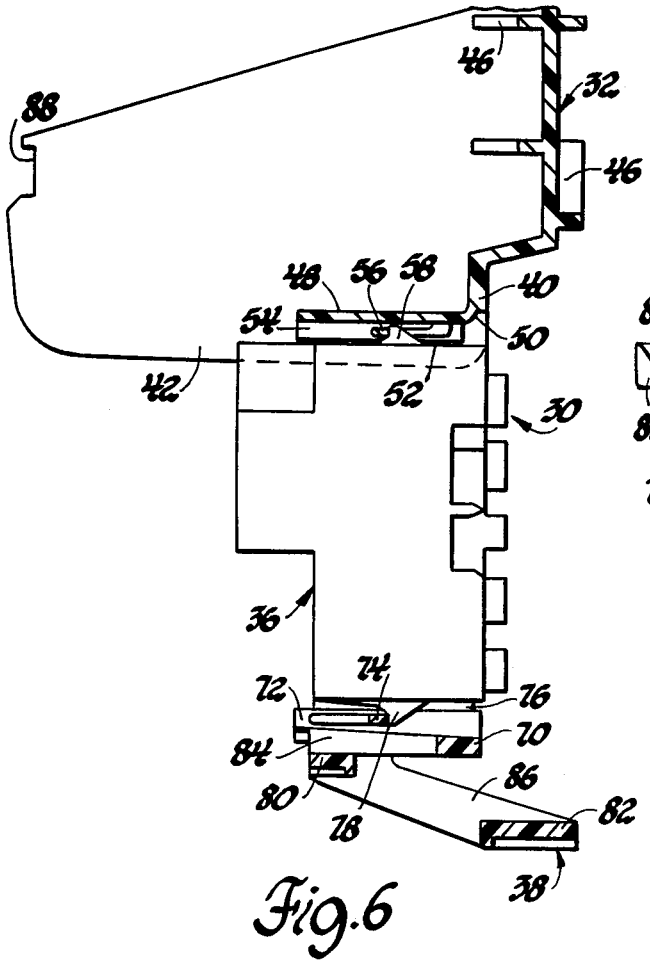
FIG. 6 is a view similar to FIG. 5 but it shows the fuse block in a pulled-down accessible position.
Figure 7:
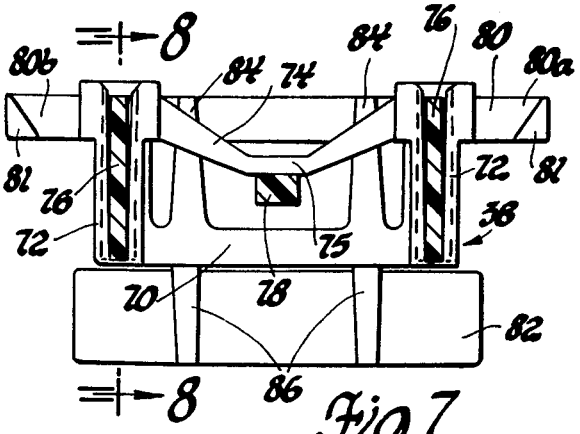
FIG. 7 is a section taken substantially along the line 7—7 of FIG. 5.
Figure 8:
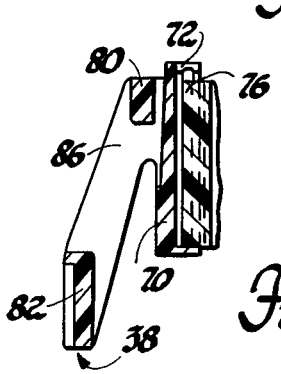
FIG. 8 is a section taken substantially along the line 8—8 of FIG. 7.

The lower front end of the bracket 32 is indented as shown in FIGS. 2, 5 and 6 to fit the particular contours of the instrument panel 20 with which the fuse block assembly 30 is illustrated.

The bracket 32 also includes a flap 48 which is integrally connected to the lower edge of the front wall 40 by an integral horizontal hinge 50. The hinge 50 permits the flap 48 and the attached fuse block 36 to move from the position shown in FIG. 5 where the fuse block 36 is stored horizontally within the bracket 32 to the position shown in FIG. 6 where the fuse block 36 hangs vertically beneath the bracket 32.

Figure 3:
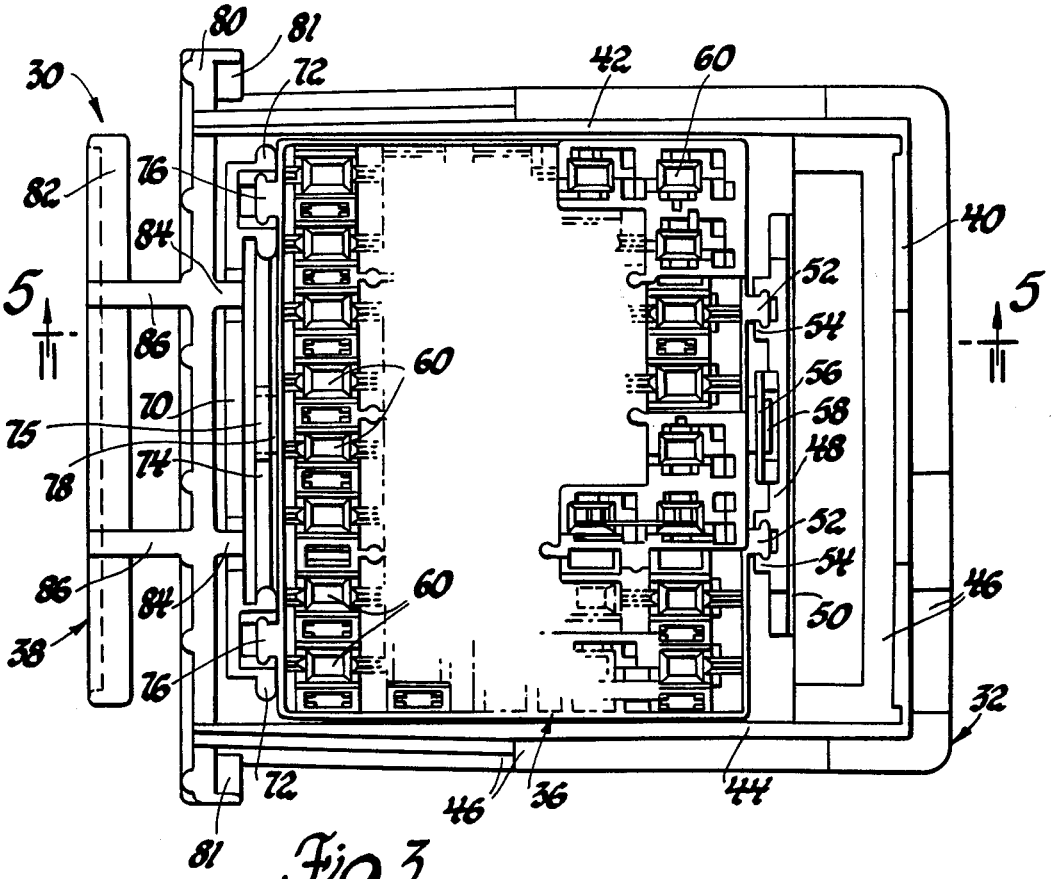
FIG. 3 is a top view of the fuse block assembly taken substantially along the line 3—3 of FIG. 2.
Figure 4:
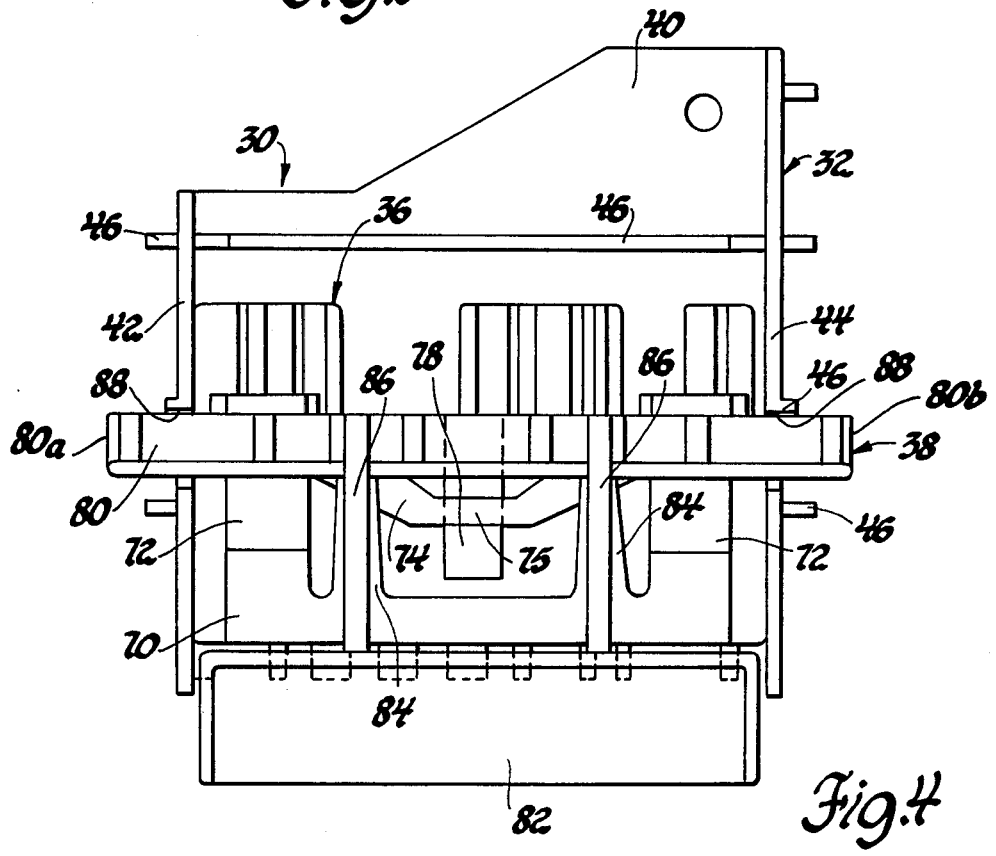
FIG. 4 is a rear view of the fuse block assembly taken substantially along the line 4—4 of FIG. 2.

The fuse block 36 is attached to the flap 48 by two T-shaped rails 52 on the top wall of the fuse block 36 which fit into a pair of ways 54 on the flap 48 as shown in FIGS. 3, 5 and 6. The ways 54 are closed at the hinged end of the flap 48 and the fuse block 36 is retained on the flap 48 by a latch arm 56 of the flap which engages a latch projection 58 of the fuse block.

The fuse block 36 is more or less typical of automotive fuse blocks in use today and, consequently, it need not be described in detail. Suffice it to say that the fuse block 36 has a number of terminal cavities 60 which extend through the fuse block 36 and which are generally arranged in rows and tiers as shown in FIG. 3. A wiring harness (not shown) comprising a number of conductor wires with terminals on the ends of each of the conductor wires leads to the fuse block 36 and the terminals are plugged into the cavities 60 through one end, in this case, the upper or rear ends which are shown in FIG. 3. Fuses, such as the fuses 62 shown in FIG. 1, are then plugged into adjacent pairs of terminals through the opposite or, in this case, front ends of the cavities. Sometimes other electrical components, such as conductor leads from electrical accessories, are also plugged into the fuse block 36.

The third major component of the fuse block assembly 30 is the manually operable latch 38 which is connected to the bottom of the fuse block 36 by an improved arrangement in accordance with this invention.

As best illustrated in FIGS. 3 through 8, the manually operable latch 38 comprises a generally flat body 70 which has a depending relatively rigid way 72 at each end. The ways 72 receive T-shaped rails 76 on the bottom wall of the fuse block 36 to connect the two pieces together. The two pieces are retained in assembly by an elongated, wing shaped latch arm 74 which is connected to the relatively rigid depending ways 72 at its opposite ends and which engages a latch projection 78 of the fuse block 36 at its mid-section 75.

The manually operable latch 38 further comprises a latch bar 80 and a handle 82 which operates the latch bar 80. The latch bar 80 is attached to the body 70 by two integral flex arms 84 which are attached to the body 70 at one end and to the latch bar 80 at the other end. The two flex arms 84 attach to the latch bar 80 about one-third of the way in from the respective ends of the latch bar 80.

The handle 82 is parallel to the latch bar 80 and connected to it by two rigid spars 86 which are aligned with the flex arms 84. The rigid spars 86 extend back toward the body ends of the flex arms 84 and beyond so that the flex arms 84 curl and the latch bar 80 moves away from the body 70 (to the left as shown in FIGS. 1 and 5) when the handle 82 is pulled toward the body 70. The opposite end portions 80*a* and 80*b* of the latch bar 80 are cantilevered out from the mid-portion of the latch bar 80 between the flex arm and spar connections and, consequently, the end portions 80*a* and 80*b* are also flexible in a direction transverse to the flex arms 84 and spars 86.

The manually operable latch 38 holds the fuse block 36 in the stored horizontal position shown in FIGS. 2, 3, 4 and 5 by the two ends of the latch arm 80 engaging in respective notches 88 in the rear edges of the side walls 42 and 44 of the bracket 32.

The fuse block 36 is pulled-down to the vertical access position shown in FIGS. 1 and 6 by operating the handle 82. Referring particularly to FIGS. 2 and 5, the operator first pulls the handle 82 forward horizontally, i.e., toward the right in the aforementioned Figures. This curls the flex arms 84 and moves the latch bar 80 rearwardly so that the ends disengage from the notches 88. After the latch bar 80 is released, the handle 82 is pulled forward and down in an arc which pivots the fuse block 36 about the hinge 50 to the vertical position shown in FIGS. 1 and 6.

To return the fuse block 36 to the stored position, the handle 82 is pushed rearwardly and up in an arc which pivots the fuse block from the vertical position shown in FIG. 6 to the stored horizontal position shown in FIG. 5. As the latch bar 80 approaches the notches 88, the opposite ends of the latch bar 80 engage the rear edges of the side walls 42 and 44 respectively. The end portions 80*a* and 80*b* are then curled outwardly until the latch bar 80 reaches the notches 88 and the ends snap-in to latch the fuse block 36 in the stored position.

The latch bar 80 has a triangular stop 81 at each end which is outward of the side walls 42 and 44. These stops help to guide the fuse block 36 into the space between the side walls 42 and 44.

The improvement of this invention resides in the arrangement of the manually operable latch 38 for retaining the latch 38 in assembly with the fuse block 36. As indicated above, this arrangement comprises the elongated wing shaped latch arm 74 which engages a cooperating latch projection 78 of the fuse block 36.

In the prior art arrangements disclosed in the aforesaid pending patent application, the latch arm of the manually operable latch 38 is integrally connected to the flat body 70 midway between the flex arms 84. As a result of such an arrangement, the prior art latch arm tends to lift away from the latch projection 78 when the handle 82 is operated to release the latch bar 80 because the curled flex arms 84 apply a torsion force to the body 70 which tends to twist the body 70.

In the improved arrangement, the elongated wing shaped latch arm 74 is connected to the relatively rigid ways 72 and, consequently, the latch arm 74 is isolated from the torsional effects on the body 70 when the latch 38 is operated to release the latch bar 80.

Another feature of the improved arrangement is that the elongated latch arm 74 is connected to the forward ends of the ways 72, and projects back toward the latch projection 78 in the latched position. This results in a greater resistance to pull-off, (i.e., sliding the manually operable latch 38 off the rails 76 to the right from the position shown in FIG. 6) in comparison to the prior art arrangements where the latch arm is attached to the flat body rearwardly of the latch projection.

The elongated latch arm 74, being connected to the relatively rigid ways 72, is also easier to mold accurately in comparison to the latch arm shown in the prior art arrangements.

We wish it to be understood that we do not desire to be limited to the exact details of construction shown and described, for obvious modifications will occur to a person skilled in the art.

The embodiments of the invention in which an exclusive property or privilege is claimed are defined as follows:

1. A manually operable latch for a hinged pull-down member, comprising;

a generally flat body having relatively rigid ways at the opposite ends thereof for attaching the latch to the pull-down member, a pair of flex arms, each having an end integrally attached to the body, a latch bar integrally attached to the respective opposite ends of the flex arms, a pair of rigid spars, each having an end integrally attached to the latch bar, a handle integrally attached to the respective opposite ends of the rigid spars whereby the flex arms are curled and the latch bar moves away from the body responsive to movement of the handle toward the body, and an elongated latch arm for retaining the latch arm on the pull-down member, said latch arm having its opposite ends integrally connected to the respective relatively rigid ways so that the latch arm is isolated from any torsional effects on the body produced by operation of the handle to curl the flex arms and move the latch bar away from the body.

2. A manually operable latch for a hinged pull-down member, comprising;

a generally flat body having a pair of parallel relatively rigid ways at the opposite ends thereto for attaching the latch to the pull-down member, a pair of flex arms, each having an end integrally attached to the body between the pair of ways and extending forwardly from the body, a latch bar integrally attached to the respective opposite ends of flex arms and extending transversely of the ways, a pair of rigid spars, each having an end integrally attached to the latch bar and extending rearwardly toward the body, a handle integrally attached to the respective opposite ends of the rigid spars and extending generally parallel to the latch bar whereby the flex arms are curled and the latch bar moves away from the body responsive to movement of the handle toward the body, and an elongated wing shaped latch arm for retaining the latch arm on the pull-down member, said latch arm having its opposite ends integrally connected to the respective relatively rigid ways so that the latch arm is isolated from any torsional effects on the body produced by operation of the handle to curl the flex arms and move the latch bar away from the body, said elongated latch arm being integrally connected to the ways so that the latch arm extends back toward the body to engage a latch projection of the hinged pull-down member disposed between the latch arm and the body.

* * * * *